United States Patent [19]

Ulyanitsky et al.

[11] Patent Number: 5,052,619

[45] Date of Patent: Oct. 1, 1991

[54] BARREL OF AN APPARATUS FOR APPLYING COATINGS BY GAS DETONATION

[76] Inventors: Vladimir J. Ulyanitsky, ulitsa Tereshkovoi, 6, kv. 129; Anatoly A. Vasiliev, ulitsa Zhemchuzhnaya, 4, kv. 23; Tamara P. Gavrilenko, ulitsa Iliicha, 19, kv. 9, all of Novosibirsk; Adolf N. Krasnov, prospekt Vernadskogo, 11, kv. 91, Moscow; Jury A. Nikolaev, ulitsa Iliicha, 19, kv. 9, Novosibirsk; Nikolai I. Podenkov, ulitsa Perekopskaya, 11, korpus 2, kv. 46, Moscow, all of U.S.S.R.

[21] Appl. No.: 555,455

[22] PCT Filed: Dec. 20, 1988

[86] PCT No.: PCTSU88/000266

§ 371 Date: Aug. 17, 1990

§ 102(e) Date: Aug. 17, 1990

[87] PCT Pub. No.: WO90/06816

PCT Pub. Date: Jun. 28, 1990

[51] Int. Cl.[5] ..... B05B 7/20

[52] U.S. Cl. ..... 239/79; 239/81; 239/85

[58] Field of Search ..... 239/79, 81, 85

[56] References Cited

U.S. PATENT DOCUMENTS

| | | | |
|---|---|---|---|
| 2,869,924 | 1/1959 | McGill et al. | 239/81 |
| 4,215,819 | 8/1980 | Garda et al. | 239/81 |
| 4,669,658 | 6/1987 | Nevgod et al. | 239/81 |
| 4,687,435 | 8/1987 | Nevgod et al. | 239/81 |

OTHER PUBLICATIONS

K. I. Schelkin and Y. L. Troshin, "Gazodinamika govenia", 1963, An SSSR Publishers, Moscow, p. 206.

A. I. Zuerev, et al., "Detonatsionnoe napylenie pokrytii", 1979, The Sudostroenie Publischers, Leningrad, p. 172.

*Primary Examiner*—Andres Kashnikow

*Assistant Examiner*—Lesley D. Morris

*Attorney, Agent, or Firm*—Fleit, Jacobson, Cohn, Price, Holman & Stern

[57] ABSTRACT

The barrel comprises a unit (1) for initiating detonation connected to a detonation chamber (2) accommodating a combustion-to-detonation transformation accelerator (3) in the form of a space lattice arranged coaxially inside the chamber (2). The size of each cell (4) of the lattice substantially equals the size of cell of a stationary detonation wave in an explosive mixture of preferred composition. The number of cells (4) of the lattice in cross section of the detonation chamber (2) grows toward an open end of the barrel defining through passages (5) for conveying gas from the unit (1) or initiating detonation to the detonation chamber (2). The peripheral passages (5) of the lattice are arranged at an acute angle ($\alpha$) to the axis of the barrel.

3 Claims, 2 Drawing Sheets

BARREL OF AN APPARATUS FOR APPLYING COATINGS BY GAS DETONATION

FIELD OF THE INVENTION

This invention relates to equipment for applying protective coatings to workpieces, and more particularly to a barrel of an apparatus for applying coatings by gas detonation.

The invention can be used most effectively in mechanical engineering, especially for applying coatings of hard metal-ceramic alloys based on tungsten carbide, chromium, and titanium to parts intended to withstand intensive abrasive wear enabling to extend tens of times the service life of machines and mechanisms.

Another application is to prevent surface damage of machines and machine parts operating in corrosive media (such as acids, alkali, sea water) or used for closing heavy-current circuits.

BACKGROUND OF THE INVENTION

Wide uses have been found lately for apparatus for applying coatings by gas detonation where acetylene is employed as the combustible ingredient of an explosive mixture due to high detonation capacity of acetylene-oxygen mixtures, or, otherwise stated, due to the shortest combustion-to-detonation path of all the available explosive gaseous mixtures. These advantages of acetylene-oxygen mixtures allow the use of short barrels in apparatus for applying coatings by gas detonation to result in a saving in the amount of metal consumed for the fabrication of the apparatus and a high capacity thereof.

However, the use of acetylene as the combustible compound of explosive gas mixtures is fraught with hazards, sice detonation of acetylene-oxygen mixtures tends to propagate even through clearances less than 0.1 mm; in addition, acetylene is capable of detonation in complete absence of oxygen in the mixture.

These properties of acetylene-oxygen mixtures necessitate extra arrangements to prevent the breakthrough of detonation from the barrel of the apparatus along gas passages to the acetylene manifold (backfire).

There is known a gas detonation apparatus (cf., U.S. Pat. No. 2,869,924) in which backfire is obviated by providing a protective tubular coil to be filled with an inert gas (nitrogen) prior to initiating detonation of an explosive mixture serving as an obstacle in the path of propagation of the detonation wave, and other devices are used for preventing backfire.

However, the use of such devices fails to guarantee complete safety during operation of apparatus for applying coatings by gas detonation employing acetylene-oxygen mixtures. Safety can be ensured only through the use of hard-to-detonate explosives as $O_2$+ methane, propane, butane and the like. An accompanying disadvantage resides in that the use of hard-to-detonate mixtures necessitates longer barrels than those in apparatus operating on acetylene-oxygen mixtures due to a substantial elongation of combustion-to-detonation path during formation of a detonation wave in the barrel and, as a consequence, resulting in a higher consumption of gas and reduced capacity of the apparatus through reducing the number of shots per second.

With respect to hard-to-detonate mixtures the combustion-to-detonation path exceeds 100 times the length of such a path in acetylene-oxygen mixtures.

In order to make use in apparatus for applying coatings by gas detonation of hard-to-detonate mixtures without increasing the size of the apparatus, while maintaining the output capacity and consumtpion of working gases, it is necessary to provide in the barrels special arrangements reducing the combustion-to-detonation path.

There is also known a barrel of a detonation apparatus having a coil at the walls thereof (cf. K. I. Schelkin and Y. L. Troshin "Gazodinamika gorenia", 1963, AN SSSR Publishers, Moscow, page 206) where propagation of the flame is accelerated through additional agitation thereof during interaction of the gas flow with obstacles, such as the coil turns. However, the use of the Schelkin coil in initiating hard-to-detonate mixtures affords a negligeable reduction in the length of the combustion-to-detonation path.

A device bearing the closest resemblance to one described in the present specification is represented in a barrel of an apparatus for applying coatings by gas detonation (cf., A. I. Zverev, et al. "Detonatsionnoe napylenie pokrytii", 1979, the Sudostroenie Publishers, Leningrad, page 172) comprising an arrangement for initiating an explosive mixture, and a detonation chamber with through holes spaced equidistantly about the periphery of its cross section.

After the barrel is filled with the explosive mixture and the gas passages are sealed the mixture is fired at the closed end of the barrel. In this apparatus the flame propagates through the holes to the detonation chamber, and then to the barrel. Such an arrangement aims at reducing the combustion-to-detonation path through more uniform firing of the mixture by transforming the initial ignition center into a plurality of ignition centers arising at the barriers between the holes. These barriers, similar to the Schelkin coil, act as obstacles in the path of propagation of the flame and through additionally agitating the flow act to reduce the length of the combustion-to-detonation path.

However, the use of the aforedescribed construction when initiating detonation in mixtures of a substantial combustion-to-detonation path also results in negligeable reduction in this length.

Initiating detonation by the Schelkin coil has similarities with the process of propagation of stationary detonation in the gas a mixture characterized by the presence of separate ignition centers in the detonation front. These ignition centers bring about local increases in pressure or compression waves moving along the front of the detonation wave across its propagation path in the barrel. These transverse waves collide with each other and with the walls of the tube to cause an increase in the pressure and temperature in the area of collision and ensure stationary propagation of detonation along the barrel.

Investigation into a stationary detonation in a tube with a smoked wall shows a characteristic network of traces with the size of each cell of such network determined by the composition of the explosive gaseous mixture and the initial pressure of this mixture in the barrel. The size of cell in the front of stationary detonation is a major characteristic of the process, and is determined experimentally.

DISCLOSURE OF THE INVENTION

The present invention aims at providing such a barrel of an apparatus for applying coatings by gas detonation in which a combustion-to-detonation accelerator would be so constructed as to reduce the length of combustion-to-detonation transformation path without increasing the size of the barrel at the same capacity of the apparatus.

The aim of the invention is attained by that in a barrel of an apparatus for applying coatings by gas detonation comprising successively connected a unit for initiating detonation, a combustion-to-detonation accelerator, and a detonation chamber, the combustion-to-detonation accelerator having the form of a space lattice arranged coaxially with the detonation chamber, the size of each cell in the lattice being equal to the size of cell of a stationary detonation wave in an explosive mixture of preferred composition, the number of cells in cross section of the lattice growing toward an open end of the barrel forming through passages for conveying gases from the detonation initiation unit to the detonation chamber, the peripheral passages of the lattice being arranged at an acute angle to the axis of the barrel.

The proposed construction of the accelerator makes it possible to reduce the length of combustion-to-detonation transformation path without increasing the size of the barrel at the same output capacity of the apparatus, which affords to use any hard-to-detonate gases (methane, butane, propane, etc.) as ingredients of the explosive mixture not having been used in the prior art due to a failure to initiate detonation with a barrel length of the known apparatus.

In addition, making use of these gaseous mixtures guarantees safe operation of the apparatus and ensures the same output capacity.

The preferred size of cell in the space lattice of the accelerator equalling the cell size in the front of stationary detonation wave is accounted for by the fact that processes occuring in the front of the stationary detonation wave are similar to those taking place during propagation of flame along the passages of the space lattice of the accelerator. It has been estabilished experimentally that bringing the cell size of the space grating to the cell size of the detonation front leads to the most effective reduction in the length of combustion-to-detonation transformation path.

The acute angle of inclination of the through passages of the lattice of the accelerator to the axis of the barrel is determined by that bringing the inclination angle close to the right angle causes a sudden expansion in the cross section of the passage in which the flame propagates to result in a sudden discharge of the products of combustion and consequently in a sharp decrease in the temperature and pressure in the flame front. These factors fail to promote combustion and can even result in that the combustion will cease.

In a preferred embodiment of the invention the space lattice of the accelerator is defined by a set of perforated disks positioned coaxially with the barrel so that holes of each such disk are partially closed by spacers of the successive disk downstream of the flow of gas.

Such an arrangement simplifies manufacture of the accelerator and ensures that combustion-to-detonation transfer for mixtures based on methane, butane, propane and the like takes place within a path length equal to the caliber of the barrel.

According to an alternative embodiment of the invention, the space lattice of the accelerator is defined by a tubular element.

This preferred arrangement enables to simplify cooling of the accelerator by conveying a cooling agent to the interior of the tubular element. Cooling of the accelerator is a major prerequisite for its application in apparatus for applying coatings by gas detonation.

BRIEF DESCRIPTION OF THE DRAWINGS

Other objects and attending advantages of the invention will become more fully apparent from a more detailed description thereof taken in conjunction with the accompanying drawings, in which.

BEST MODE OF CARRYING OUT THE INVENTION

Figure 2:
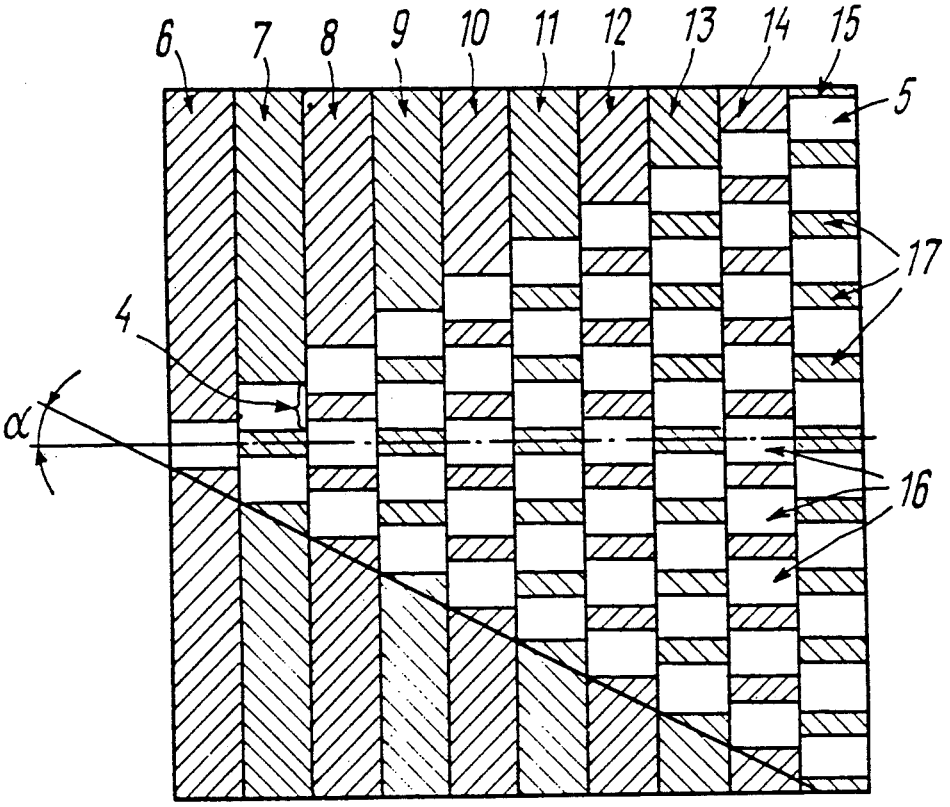
FIG. 2 is a longitudinal sectional view of a combustion-to-detonation accelerator.
Figure 1:
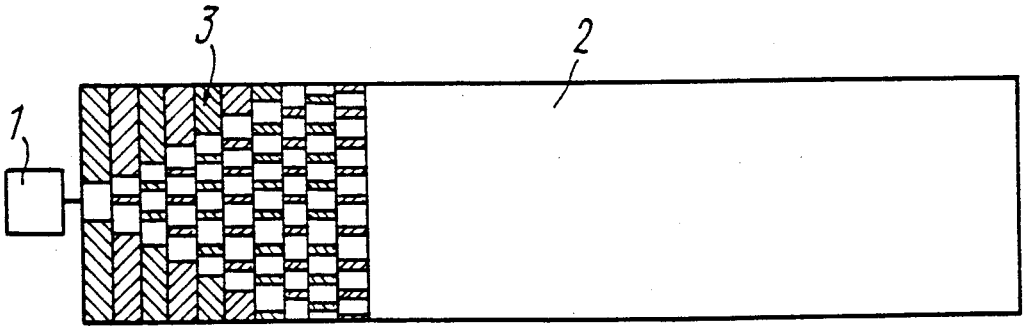
FIG. 1 is a longitudinal sectional view of a barrel according to the invention.

The proposed barrel of an apparatus for applying coatings by gas detonation comprises a unit 1 (FIGS. 1 and 2) for initiating detonation connected to a detonation chamber 2 through an accelerator 3 of combustion-to-detonation transformation. The accelerator 3 has the form of a space lattice arranged coaxially with the chamber 2. The size of cell 4 of the lattice substantially equals the cell size of a stationary detonation wave in an explosive mixture of a preferred composition. The number of cells 4 in cross section of the lattice increases toward the open end of the barrel defining through passages 5 to convey gas from the detonation initiation unit 1 to the detonation chamber 2. Peripheral passages 5 of the lattice are at an acute angle $\alpha$ to the axis of the barrel (in a preferred embodiment of the invention this angle is in the order of 40°).

The space lattice of the accelerator 3 is defined by a set of perforated disks 6,7,8,9,10,11,12,13,14,15 positioned coaxially in the chamber 2; in each pair of adjacent disks, such as disks 14,15, holes 16 are partially closed by barriers 17 between the holes of the successive disk 15 downstream of the flow of the explosive gas mixture to define the cells 4. In each disk 6,7,8,9,10,11,12, 13,14,15 the distance between the axis of two adjacent holes 16 is less than 1 to 2 diameters of the hole 16. The number of holes 16 in the disks 6,7,8,9,10,11,12,13, 14,15 grows toward the open end of the barrel.

The bodies of the disks 6,7,8,9,10,11,12,13,14,15 has passages (not shown) for feeding a cooling agent thereto to cool the disks 6,7,8,9,10,11,12,13,14,15 in operation of the apparatus.

The proposed barrel operates in the following manner.

The explosive gas mixture fed to the barrel from a mixer (not shown) is fired in the hole 16 of the first disk 6 downstream of the gas flow by the detonation initiation unit 1. The flow of unburned gases is agitated before the flame front at the barriers 17, whereby the flame is accelerated and a series of compression waves are formed before it. As the compression waves are reflected from the barriers 17, temperature rises to a point sufficient for self-igniting the mixture before the flame front as early as in a cross section of the barrel where disks 10 and 11 are situated, which is accompanied by a large number of self-ignition centers in turn generating more compression waves initiating new ignition centers at the barriers 17 of the disk 12, etc. As a result, the process of combustion is repeatedly intensified and proceeds as a volumetric process, which results in the appearance of powerful shock waves in the cells 4 of the space lattice of the accelerator 3 capable of independently igniting the mixture already in the accelerator 3 or at the outlet therefrom.

Figure 3:
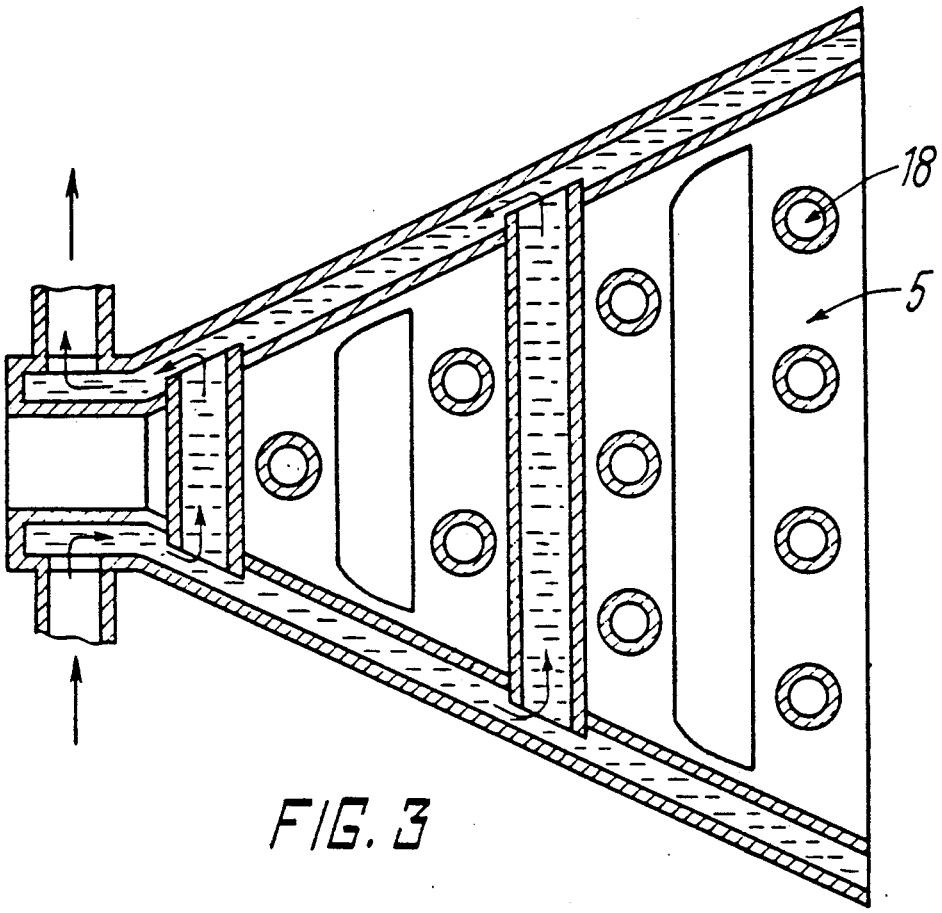
FIG. 3 is longitudinal sectional view of a modified form of the accelerator with a tubular element.

FIG. 3 shows an alternative embodiment of the space lattice of the accelerator 3 in the form of a tubular element 18 placed in such a manner that the element 18 is used for feeding a cooling agent thereto, whereas its outer surface forms cells 4 defining the through passages 5 for conveying gases to the barrel.

Research into a stoichiometric mixture of methane and oxygen (size of cell in the front of stationary detonation—4 mm) has shown that the detonation process stabilizes after the wave leaves the accelerator 3 already at a distance 1.5–2 cm from the last disk 15. Such an accelerator operates efficiently with a wide range of propane-butane based compositions (cell size 6 to 1.5 mm). Other alternative sizes and shapes of the cells 4 of the space grating of the accelerator 3 are possible. However, the size of the cell 4 of the space grating of the accelerator 3 should not substantially differ from the cell size at the front of the stationary detonation, and as the optimum it should be 0.5–2 times the size of cell in the front of stationary detonation.

The heretofore described construction of combustion-to-detonation accelerator provided in the barrel and having a length of less than one caliber allows to reduce the length of the combustion-to-detonation transformation path (with the length of the accelerator considered) to one caliber of the barrel.

Thanks to providing an accelerator 3 in the barrel of the apparatus for applying coatings by detonation spraying, it is possible to use gas mixtures based on methane, propane, butane, etc, without structurally modifying such apparatus, or changing its size and capacity. The use of explosive mixtures based on such gases ensures high quality of coatings surpassing the characteristics of coatings obtained by using acetylene-oxygen mixtures.

INDUSTRIAL APPLICABILITY

The invention can find application in motor engineering for applying coatings of metalloceramic hard alloys based on tungsten carbide, chromium and titanium to parts of machines and mechanisms intended to withstand abrasive and friction wear to result in a service life of such machines and mechanisms tens of times longer.

In addition, the invention can be used for applying coatings protecting the surfaces of machine parts in corrosive media (such as acids, alkali, sea water) or employed for closing heavy-current circuits.

CLAIMS:

1. A barrel of an apparatus for applying coating by gas detonation comprising successively connected a unit (1) for initiating detonation, an accelerator (3) of combustion-to-detonation transformation, and a detonation chamber (2), characterized in that the accelerator (3) has the form of a space lattice arranged coaxially with the detonation chamber (2), and comprising a plurality of cells the size of each cell (4) in the lattice being equal to the size of a cell of a stationary detonation wave in an explosive mixture of preferred composition, the number of cells (4) in cross section of the lattice growing toward the open end of the barrel defining through passages (5) for conveying gases from the detonation initiation unit (1) to the detonation chamber (2), whereas the peripheral passages (5) of the lattice are arranged at an acute angle ($\alpha$) to the axis of the barrel.

2. A barrel as claimed in claim 1, characterized in that the space lattice of the accelerator (3) is defined by a set of perforated disks (6,7,8,9,10,11,12,13,14,15) positioned coaxially with the barrel so that holes of each disk (6,7,8,9,10,11,12,13,14,15) are partially closed by spacers (17) between holes (16) of the successive disk (7,8,9,10,11,12,13,14,15) downstream of the gas flow to define the cells (4).

3. A barrel as claimed in claim 1, characterized in that the space lattice of the accelerator (3) is defined by a tubular element (18).

* * * * *